US009656181B2

(12) United States Patent
Hocherman

(10) Patent No.: US 9,656,181 B2
(45) Date of Patent: May 23, 2017

(54) PROJECTING LIGHT EFFECTS FOR CHILDREN

(71) Applicant: American Innovative, LLC, Beverly, MA (US)

(72) Inventor: Adam B. Hocherman, Manchester, MA (US)

(73) Assignee: PlayMonster LLC, Beloit, WI (US)

( * ) Notice: Subject to any disclaimer, the term of this patent is extended or adjusted under 35 U.S.C. 154(b) by 0 days.

(21) Appl. No.: 14/197,485

(22) Filed: Mar. 5, 2014

(65) Prior Publication Data

US 2014/0273731 A1 Sep. 18, 2014

Related U.S. Application Data

(60) Provisional application No. 61/786,809, filed on Mar. 15, 2013.

(51) Int. Cl.
*H01R 33/00* (2006.01)
*A63H 33/22* (2006.01)

(52) U.S. Cl.
CPC ..... *A63H 33/22* (2013.01)

(58) Field of Classification Search
CPC ..... A63H 33/22
USPC ..... 362/232, 249.03, 249.16, 277, 311.02, 362/311.14, 351, 360–361, 363, 644, 806
See application file for complete search history.

(56) References Cited

U.S. PATENT DOCUMENTS 7,871,192 B2 * 1/2011 Chien ..... 362/641
8,303,150 B2 * 11/2012 Chien ..... 362/555

OTHER PUBLICATIONS

Cloud•b, "Twilight Turtle" (© 2002, 2013) [online] [retrieved on Mar. 5, 2014]. Retrieved from the Internet: http://cloudb.com/sight/twilight-turtle-classic-mocha, 2 pages.

* cited by examiner

*Primary Examiner* — Jason Moon Han
(74) *Attorney, Agent, or Firm* — Fish & Richardson P.C.

(57) ABSTRACT

Among other things, there is a stationary light source, a stationary aperture between the light source and a projection surface, and a device to modulate light from the light source that passes through the aperture and strikes the projection surface to cause a light effect on the projection surface. In some cases, projected motion and/or twinkling effects are produced in a simple, low-cost and durable manner.

4 Claims, 5 Drawing Sheets

PROJECTING LIGHT EFFECTS FOR CHILDREN

RELATED APPLICATION

This application claims priority to U.S. provisional application No. 61/786,809, filed on Mar. 15, 2013, the contents of which are incorporated herein by reference.

BACKGROUND

This description relates to projecting light effects for children.

Among known ways of projecting light effects for children are projecting light through a colored slide to produce an image on a wall or ceiling, moving a focused lamp or laser mechanically to change an angle of light projected by the light source using a gear motor, and producing a static pattern of shapes on a wall or ceiling by shining a light source through a pattern of apertures.

Static light or colored scenes may be boring and cause the viewer to lose interest. Devices that use a gear motor to produce a motion effect may create unwanted noise in a silent bedroom and add cost, complexity and points of failure that are undesirable in an inexpensive children's product.

SUMMARY

In general, in an aspect, there is a stationary light source, a stationary aperture between the light source and a projection surface, and a device to modulate light from the light source that passes through the aperture and strikes the projection surface to cause a light effect on the projection surface.

Implementations may include any one or a combination of any two or more of the following features. There are two or more light sources that are separately controllable to be turned on or off or faded on or off. There are two or more stationary apertures on a housing. The device to modulate the light includes a circuit to control the turning on or turning off or fading on or fading off of the light source. The device to modulate the light includes a circuit to control the turning on or turning off or fading on or fading off of two or more light sources. The device to modulate the light includes an interceptor that can be caused to intercept or not to intercept light that passes through the aperture. The interceptor includes an electronically controllable array of pixels or segments. The interceptor includes a mechanical element that intercepts the passage of light. The two or more light sources are arranged in a row, in a circle, in an array, or in another pattern. The apertures are arranged in a pattern. The device to modulate light includes a circuit to control the turning on or turning off or fading on or fading off of two or more light sources and an interceptor that can be caused to intercept or not to intercept light that passes through the aperture. The light source and the device to modulate the light have no moving parts.

In general, in an aspect, a time-changing light effect is imposed on light projected in a pattern on a surface in a room by passing light from a stationary light source through a stationary aperture and controlling light passing from the light source to the surface so that the pattern on the surface changes over time.

The pattern changes over time by moving along the projection surface. The pattern changes over time by twinkling on the projection surface. The light passing from the light source to the surface is controlled by controlling the light source electronically. Controlling the light passing from the light source includes turning on or turning off or fading on or fading off two or more light elements in a timed pattern. Controlling the light passing from the light source to the surface includes intercepting the light or not intercepting the light.

In general, in an aspect, a method includes enabling a moving and/or twinkling projected light effect without the need for gear motors, linkages or other moving parts. Implementations may include the above mentioned effects incorporated into a stand-alone device or implemented in conjunction with a clock, music player, sound machine, mobile or any number of other devices that may be found in a child's nursery or bedroom or in another room in the house.

These and other aspects, features, and implementations, and combinations of them can be expressed as methods, apparatus, components, systems, software, business methods, program products, means and steps for performing functions, and in other ways.

Other aspects, features, and implementations will become apparent from the following description, and from the claims

DESCRIPTION

MOTION EFFECT

Figure 1:
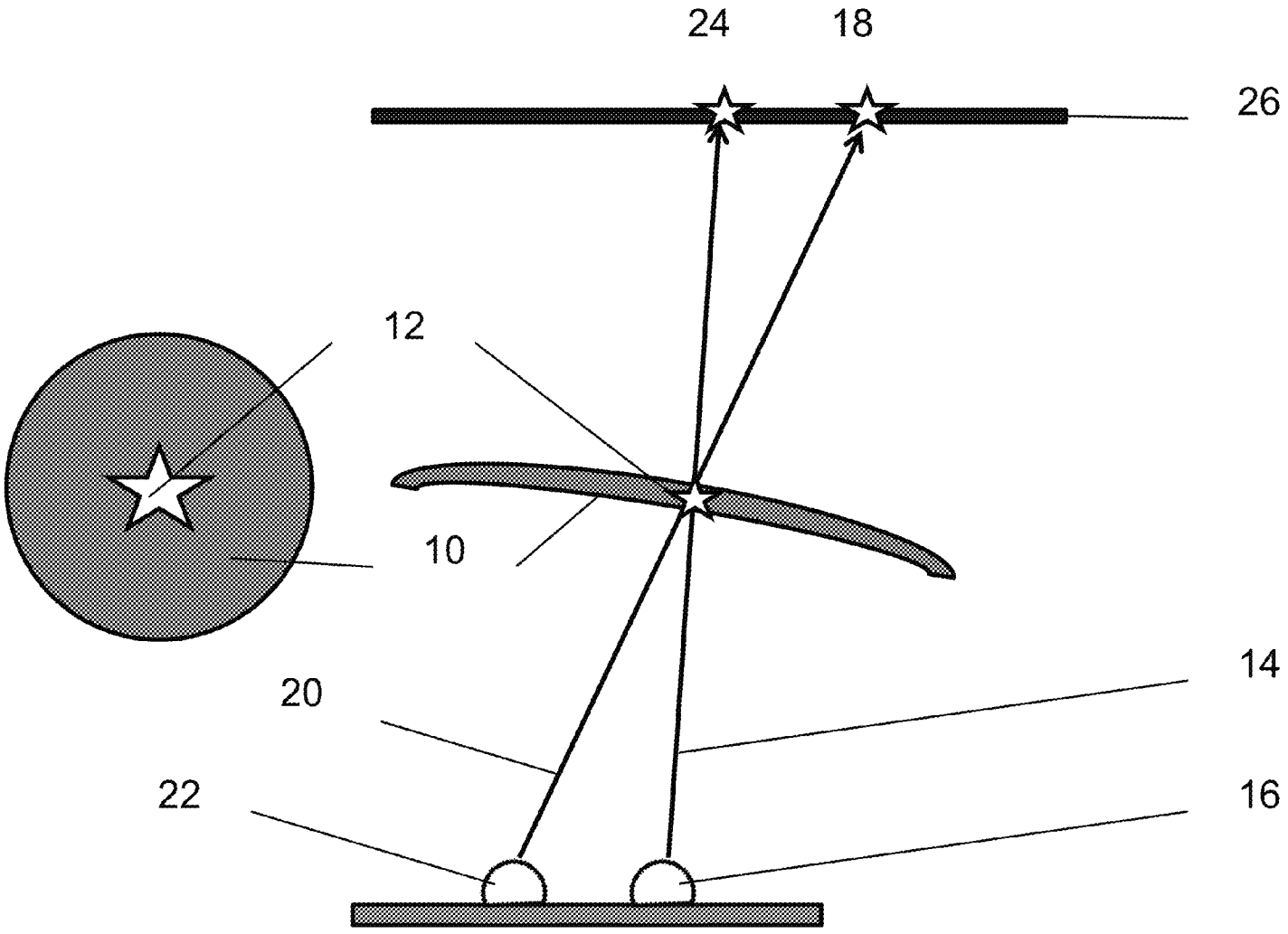
FIG. 1 depicts a motion effect.

As shown in FIG. 1, in some implementations, a motion effect in projected light is created by, in effect, varying the effective location of the light source by using an array of multiple light sources, arranged in a pattern. The offset (distance) between the adjacent light sources is great enough to create a type of (or the appearance to a viewer of) motion animation for light that passes from the light sources through a fixed aperture, when the light sources are turned on and off or are faded on and faded off in a predefined or a random sequence. This effect can be achieved without moving the aperture pattern and without physically moving the light source, although the effect can also be combined with moving the aperture pattern or moving the light source, or both.

In some examples, as shown in FIG. 1, light 14 from a first light source 16 passes through an aperture 12 located in a housing 10 and creates a projected image 18 on projection surface 26. The shape and size of the image depend on the shape and size of the aperture, and the distance of the light source to the aperture and of the aperture to the projection surface. Light 20 from a second light source 22 passes through aperture 12 and creates a second projected image 24 on projection surface 26. In this simple example, by alternately fading on and fading off the two light sources, or by simply turning one off when the other one is turned on, the effect of an image that jumps or otherwise appears to move smoothly across the projection surface can be created.

Only a single aperture is shown in FIG. 1. More elaborate implementations could involve projecting light through multiple apertures, including apertures arranged in a complex aperture pattern arrangement including a few, or dozens, or hundreds of aperture openings.

Figure 2:
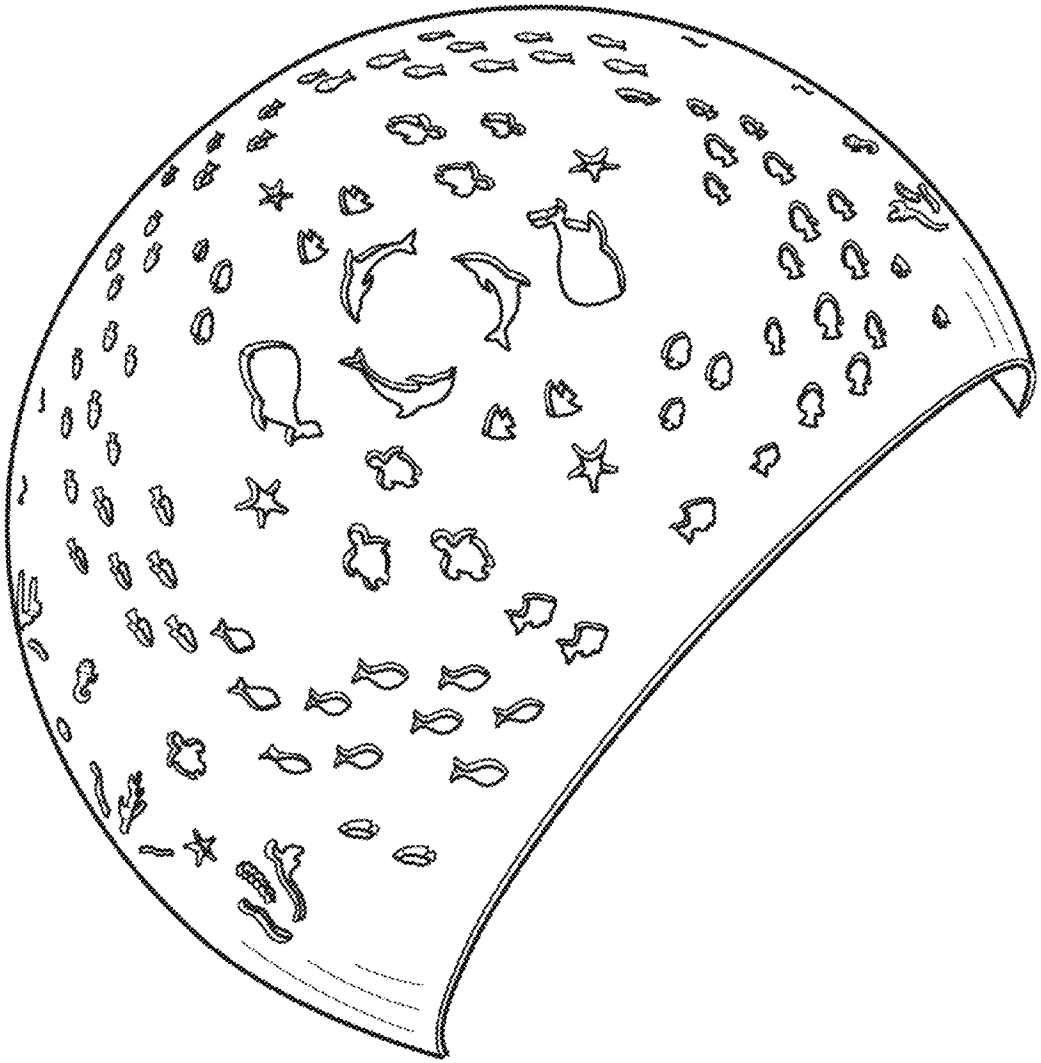
FIG. 2 shows an aperture pattern design that depicts an ocean scene.
Figure 3:
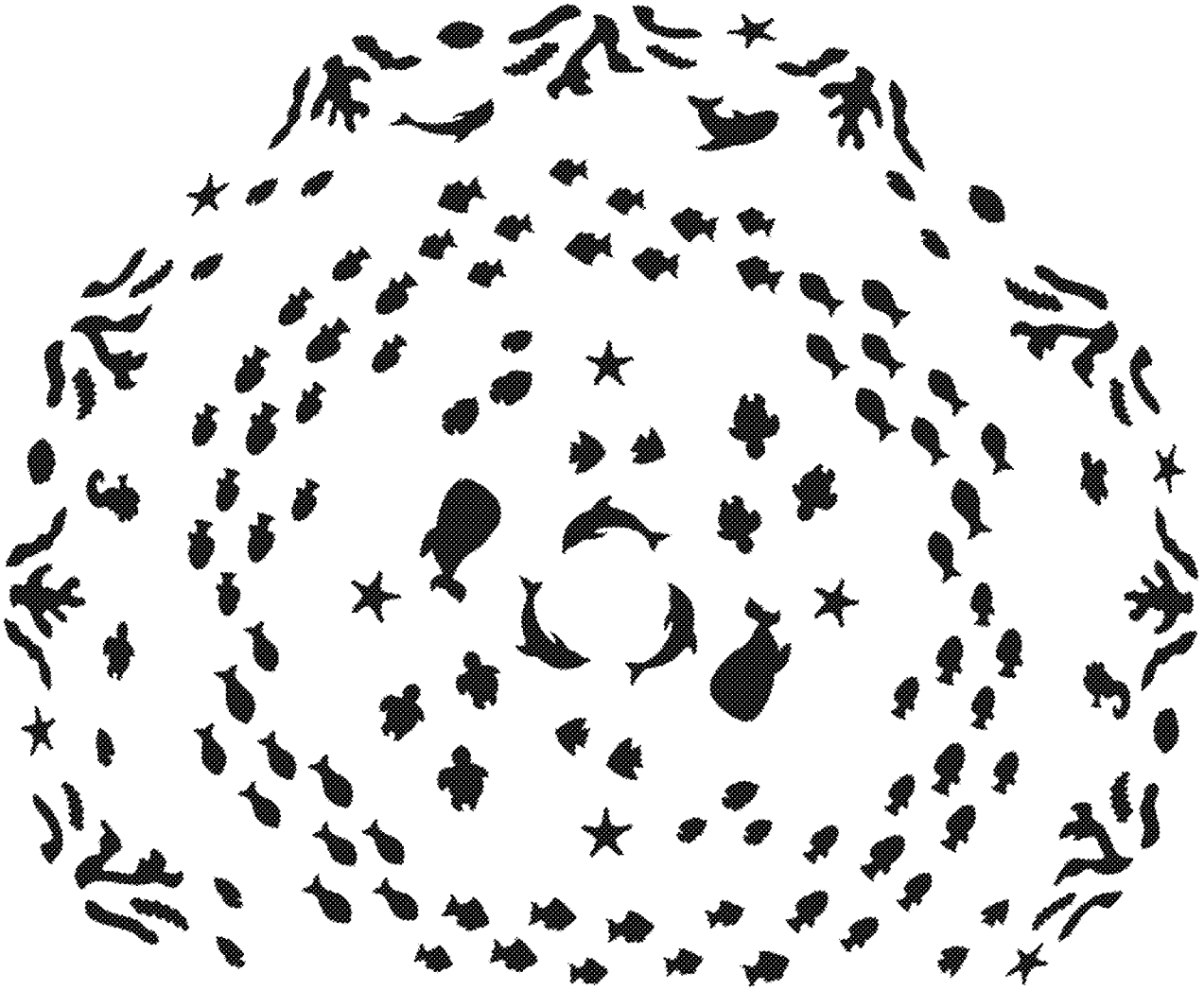
FIG. 3 shows an example of a pattern projected on a projection surface.

As shown in FIG. 2, an ocean scene could be created by arranging, on a housing, many aperture openings that look like fish, whales, seaweed, and/or other shapes related to the ocean. FIG. 3 depicts what an example of an ocean scene might look like on the projection surface at one moment in time. Any number of other such scenes may be envisioned using other arrangements of aperture openings of different shape classifications—a jungle theme or cars and trucks, to name two examples. The apertures could have a variety of sizes and shapes and the patterns in which the apertures are arranged are almost endless. The housing need not be hemispherical and could be of a wide variety of configurations. More than one housing could be used each bearing a subset of the apertures.

Figure 5:
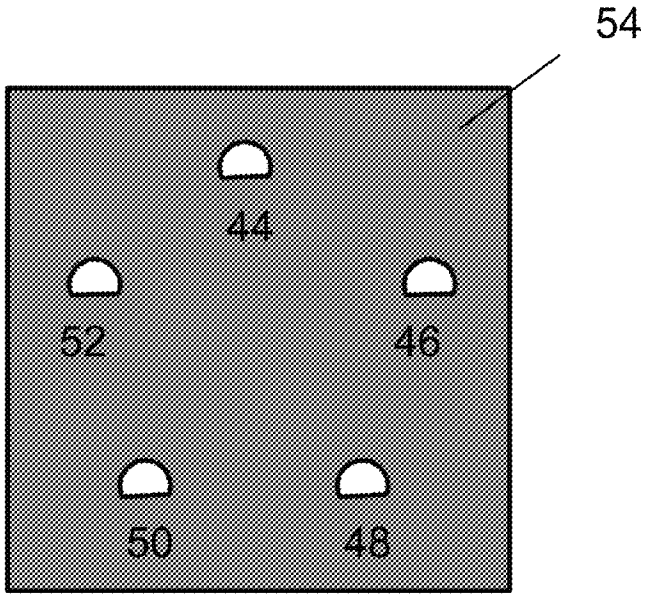
FIG. 5 shows a top view of an example implementation of a circular arrangement of light sources.
Figure 4:
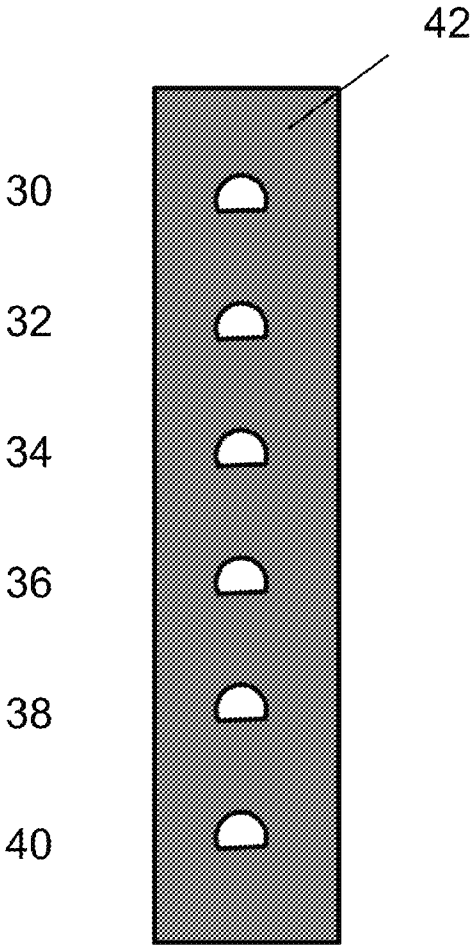
FIG. 4 shows a top view of an example implementation of a linear arrangement of light sources.

More elaborate implementations could involve arranging a larger number of light sources in a two-dimensional space so as to create a linear, rotational or other effect by utilizing these same principles. For example, if the light sources 16 and 22 from FIG. 1 were supplemented with additional light sources, spaced in a similar manner and arranged linearly (in other words a row of equally spaced light sources) it is easy to imagine how the effect of a shooting star might be created. In the example implementation depicted in FIG. 4, light sources 30-40 are arranged in exactly this fashion on a circuit board 42. In the example implementation depicted in FIG. 5, light sources 44-52 are mounted on circuit board 54 in a circular arrangement. When faded in-and-out in sequence, this arrangement of light sources would produce a pattern of light that appeared to have a circular or rotational motion. Other patterns of light sources are also possible including two-dimensional or even three dimensional arrays. A circuit (not shown) would turn the lights on and off or cause them to fade on or fade off according to a desired pattern. The circuit could be arranged to provide more than one control pattern to cause different selectable light motion effects.

The projection surface can be a wall, a ceiling, a piece of furniture, or any other surface, flat or otherwise, within a typical room.

TWINKLE EFFECT

Figure 6:
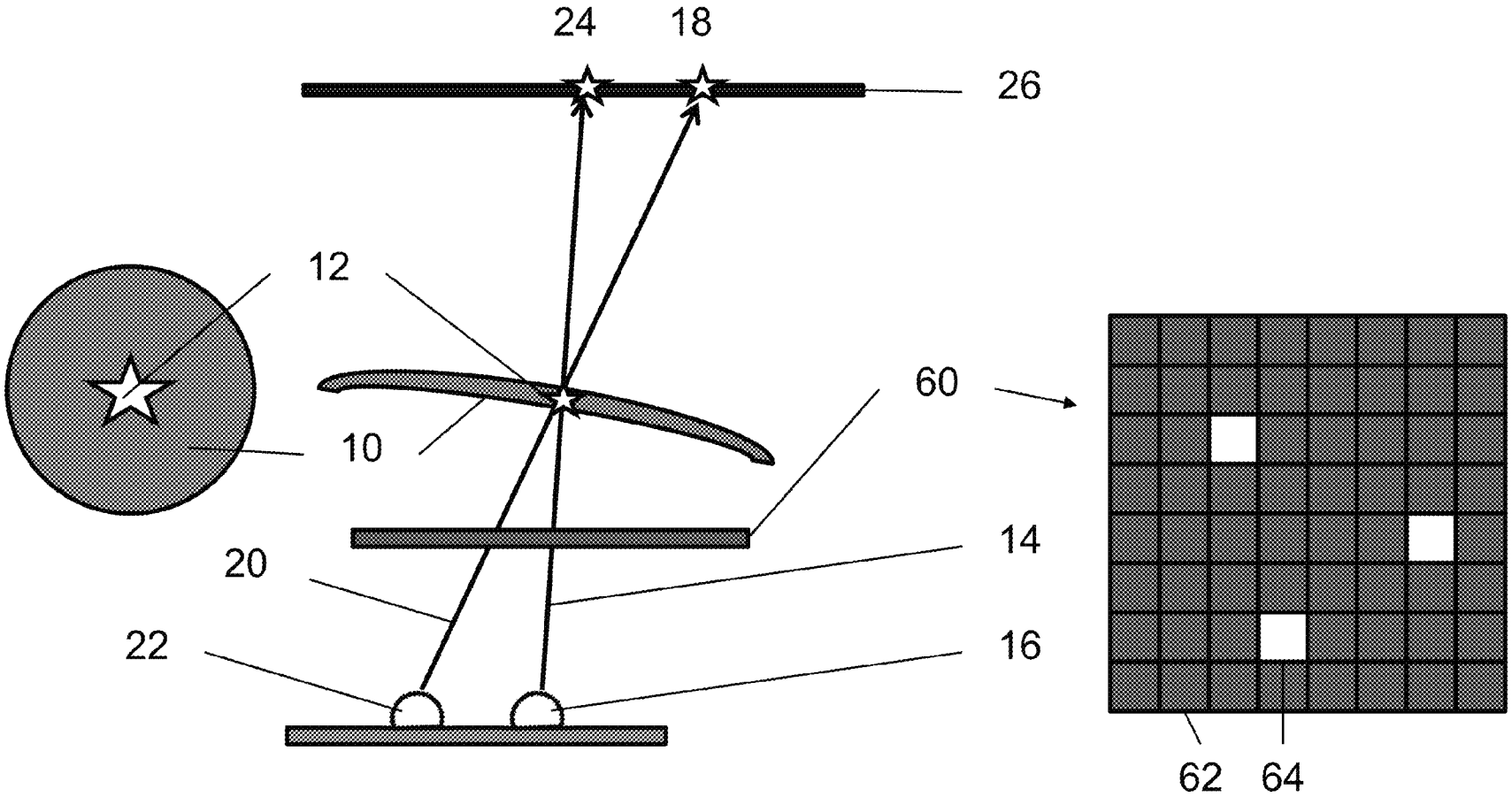
FIG. 6 shows a diagram depicting one implementation of a twinkle effect.

As shown in FIG. 6, if carefully positioned, a beam of light that passes through an aperture to create a projected shape could be "turned off" by intercepting the beam using an opaque object. In some implementations, a twinkle effect is created by alternately intercepting, and then ceasing to intercept, a beam of light or a portion of said beam, by use of a matrix of interceptors. The matrix of interceptors could be pixels or segments of a liquid crystal display (LCD). Once the light sources have been fixed in space and the aperture pattern has been designed and fixed in space, a software algorithm (run by a microprocessor that is part of the device and is not shown in the figure) controls a binary state (opaque or translucent) of each of the LCD segments in order to create the desired effect.

In some cases, the LCD segments are arranged in a grid, the individual segments of which are of such a size that the software algorithm would have sufficient control over which portions of the light were desired to be blocked and which portions of the light were desired to be transmitted in order to create a "twinkle" or other similar effect on a pattern appearing on a projection surface, such as the walls and/or ceiling of child's darkened bedroom.

In FIG. 6, light 14 and 20 from light sources 16 and 22 are selectively intercepted by a liquid crystal display (LCD) 60 before passing through aperture 12 located in a housing 10 in order to create projected images 18 and/or 24 on the projection surface 26. LCD 60 contains a matrix of segments which may be programmatically (or by some other means, such as through the use of individual, manual buttons) turned to an on state 62 (opaque) or an off state 64 (transparent) in order to selectively block portions of the light 14 and/or 20 responsible for creating the projected images 18 and/or 24 on the projection surface 26. In another implementation a negative-type LCD is used in which case an opaque state might be created by the off state of a given segment and the translucent state might be created by the on state of a given segment. In the arrangement shown in FIG. 6, both apparent motion and twinkling could be achieved.

Other implementations of light interceptors might include using one or more magnetically operated, physical interceptors or using interceptors, however implemented, that are arranged in a pattern other than that of a matrix. In another implementation, interception of light may be achieved by using other means such as an array of arms mounted on a shaft or a punched disc, either of which rotates by some means for purposes of blocking and/or allowing light to pass through. Other types of selective light blocking may be achieved using other than rotational motion, such as linear motion or special motion created by some other means, such as a mechanical linkage.

COMBINATION EFFECT

In some cases, the motion and twinkle effects could be combined (and combined with other effects) in order to create an even more elaborate effect for purposes of engaging, soothing, or entertaining the observer of the device's effects. For example, if the pattern of apertures represented stars or constellations, the idea of a slowly moving and twinkling night sky might be created. Other classes of aperture shapes and arrangements could be easily imagined to create any number of engaging projected thematic scenes such as an underwater motif, a jungle motif or similar.

The effects that we have described can be achieved in simple, low-cost endurable ways.

Other implementations are also within the scope of the following claims.

For example, although we have described controlling the light passing to the projection surface in terms of turning light sources on and off for fading them on and off, a wide variety of control profiles can be used over time that are more complicated. The same is true for the interceptor pixels or segments. Furthermore, color effects can be achieved by controlling the color of pixels or segments in the interceptor panel. The interception of the light does not need to be absolute (that is, on or off) but can be partial interception, for example. The color of the source light may also be changed and/or controlled.

We sometimes use the term "time changing light effect" and we mean it in the broadest sense to include, for example, any respect in which the light projected on the surface of the room changes over time, such as in intensity, color, and in any kind of time-changing profile.

The devices and the ways of using them that we describe here can be incorporated in a wide variety of products that can be used in a room. For example the products can involve clocks, toys, night-lights, trays, bookends, and any other kind of product that is useful in a room. Although these products can be specifically intended for children, other products can have other uses, including decorative and functional.

In some cases there can be multiple light sources and a single aperture or multiple apertures and a single light source.

The invention claimed is:

1. An apparatus comprising three or more stationary light sources in a row or five or more light sources in a circle, the light sources each being separately controllable to be turned on or off or faded on or off, an interceptor having an array of interceptor elements each interceptor element being controllable either to pass or obstruct light passing from each of the light sources toward a projection surface of the apparatus, and a circuit to control the on or off or faded or not faded state of each of the light sources and to simultaneously control the passing or obstruction state of each of the interceptor elements to cause a pattern of lights to appear to move linearly across the projection surface and to appear to twinkle as the pattern moves.

2. The apparatus of claim 1 in which the interceptor comprises an electronically controllable array of pixels or segments.

3. The apparatus of claim 1 in which the interceptor comprises a mechanical element that intercepts the light.

4. The apparatus of claim 1 in which the light sources and the interceptor have no moving parts.

* * * * *